US006701746B1

(12) United States Patent
Bentley

(10) Patent No.: US 6,701,746 B1
(45) Date of Patent: Mar. 9, 2004

(54) OPENABLE FINGER-RING

(76) Inventor: Daniel Bentley, Frederiks Alle 75, 2.th., DK-8000 Aarhus C (DK)

( * ) Notice: Subject to any disclaimer, the term of this patent is extended or adjusted under 35 U.S.C. 154(b) by 0 days.

(21) Appl. No.: 09/959,504

(22) PCT Filed: Apr. 27, 2000

(86) PCT No.: PCT/DK00/00215

§ 371 (c)(1),
(2), (4) Date: Dec. 17, 2001

(87) PCT Pub. No.: WO00/65947

PCT Pub. Date: Nov. 9, 2000

(30) Foreign Application Priority Data

Apr. 28, 1999 (DK) ..... 1999 00582

(51) Int. Cl.[7] ..... A44C 19/00
(52) U.S. Cl. ..... 63/15; 63/12; 63/15.7
(58) Field of Search ..... 63/12, 13, 15, 63/15.2, 15.3, 15.5, 15.7

(56) References Cited

U.S. PATENT DOCUMENTS

| | | | | | |
|---|---|---|---|---|---|
| 122,328 | A | * | 1/1872 | Northup | 63/13 |
| 217,092 | A | * | 7/1879 | Greene | 63/12 |
| 234,093 | A | * | 11/1880 | Untermeyer | 63/15.7 |
| 245,297 | A | * | 8/1881 | Heckmann | 63/12 |
| 260,692 | A | * | 7/1882 | Krementz | 63/12 |
| 465,830 | A | * | 12/1891 | Bulova | 63/13 |
| 1,128,084 | A | * | 2/1915 | Wilcoxon | 63/15.7 |
| 1,407,863 | A | * | 2/1922 | Hochenauer, Jr. | 402/20 |
| 5,575,161 | A | * | 11/1996 | Hinchey | 63/33 |
| 6,237,367 | B1 | * | 5/2001 | Cheng | 63/12 |

FOREIGN PATENT DOCUMENTS

| | | |
|---|---|---|
| EP | 0 278 883 | 8/1988 |
| EP | 0 375 565 | 6/1990 |
| GB | 584404 | 1/1947 |

* cited by examiner

*Primary Examiner*—Andrea Chop
(74) *Attorney, Agent, or Firm*—James Creighton Wray; Meera P. Narasimhan

(57) ABSTRACT

It is an age-old problem that with time finge-rings can become difficult to remove, while in general they should not, after all, be all too easy to take off. With the invention there is provided an openable ring which, it should be noted, does not comprise irritating hinge parts or releasing means, in that the one of the four geometric main elements of the ring is configured as a substantially straight piece which can be turned outwards from the natural plane of the ring, while in the turned inwards position it is in snap-lock engagement with the opposite end of the remaining, substantially U-shaped ring element. For this releasable locking, use is thus made of the natural elasticity of the ring element, and it is the whole of the outwardly-pivotal piece in itself which is used as the operating element for the opening and closing of the ring.

17 Claims, 1 Drawing Sheet

OPENABLE FINGER-RING

BACKGROUND OF THE INVENTION

The present invention concerns a finger-ring of the type which is commonly used as a jewellery item, an engagement ring or wedding ring or for other purposes.

It is commonly known and experienced by most ring wearers that with time a ring becomes more and more difficult to remove. Since the period of time for which a ring is used may well extend over decades, and while at the same time there occurs a physical organic changing of the fingers, joints, bones, muscles and sinews, the difficulty involved in the removal of a ring or the placing of a ring on the finger generally increases with time and the person's age.

The extent of the difficulty herewith is immediately greater than is assumed, and is increasing in general with the increasing use of several rings on both hands by both younger men and women.

At the same time, a precondition for productions, processes and the operation of machines is to an increasing degree that rings and other metal elements can be removed, either out of regard for bacteriological conditions or accumulated impurities which can have influence on the result of the finished product, not least in the production of foodstuffs, medicinal products or corresponding precision or sterile production conditions, where general cleanliness is a necessity for the whole production process out of regard for the result of the finished product.

A completely different problem is that of the thickening of the individual's fingers or joints as a result of sickness, changes in connective tissues and the like which, for example, arise in cases of arthritic ailments, or swelling as result of local oedema in the limbs and fingers with corresponding consequences.

For a large group of people, the removal and replacing of finger-rings thus arises as a daily recurring difficulty as a consequence of working situations, washing of hands and the like.

Since rings are often of a great symbolic and personal value to the wearers, the disadvantages connected herewith are a daily phenomenon which must be overcome, but which still does not discourage any great number of people from wearing rings, even though this involves problems and irritation.

There has thus long been an increasing need for a ring which can be removed and replaced even after use for many years. The ring could possibly be executed with the possibility of a certain elastic expansion, but this is hardly consistent with the general expectation that a ring should be of a firm, solid structure, and the necessary single-handed operation could be difficult. The ring could rather be configured in a manner corresponding to that of openable bangles or bracelets, but this is made difficult by the fact that precisely at the fingers there is very poor possibility for the provision of various hinge and releasing parts, since any irregularity here will have a strongly irritating effect.

SUMMARY OF THE INVENTION

With the invention it has thus been accepted that the desire for an openable, conventional finger-ring can hardly be realised in practice, but it is also recognised that a fully usable solution can be created if the conventional round ring configuration is modified in a manner which in practice is fully acceptable, i.e. to a more or less edged configuration, in the extreme case to a purely quadratic shape. With such a shape as the starting point, the situation will arise that the one, non-integrated side of the quadratic sides without any form of noticeable hinge will be able to swing out around a pivot axis defined by an adjoining square side, while the free end of this outwardly-pivotal side will be able to co-operate in the manner of a snap-lock with the free end part of the oppositely adjoining square side of the ring. Such a snap-lock will require the incorporation of special spring means, in that for this purpose direct use will be able to be made of the elasticity of or in the three coherent square sides, so that upon opening and closing the free end of the pivotal side must merely give rise to a transitional expansion of the fixed U-part, which is formed by the three sides which are connected together. There are hereby achieved two important functions, i.e.

1) the outwardly-pivotal side or ring-beam Dart can be turned outwards or inwards without coming into conflict with the finger, i.e. for the opening and closing respectively of the said U-shaped part, and
2) the relevant side or beam-part in itself constitutes the necessary operating element for implementing the opening and the closing, i.e. this element does not have the character of any irritating excrescence, but is a part of the ring element itself. When attention is focussed fundamentally on a ring structure with four straight sides, one of the reasons is that the pivotal ring part in itself should be more or less straight in order to be able to swing outwards and inwards without conflict with the finger. There is, however, the further reason that in order to provide a mechanically strong pivot connection between the pivotal part and the U-part, it is tantamount to a necessity that the pivotal part is configured with a pivot pin which, under the cramped space conditions, can be accommodated in a hole in the adjoining end part of the U-part, whereby this part, which in practice will constitute the main part of the relevant side of the U-part, will in itself be more or less straight. Actually, the remaining part of the U-part can be configured in a curved manner, but in practice the ring designer will prefer a harmonic shape with two substantially straight ring side pieces and slightly curved under and upper-side pieces. In principle, it can be either the upper or the under-piece which is the pivotal part, but since many rings have a specially emphasised upper part it will be more natural that it is precisely this part which is the pivotal part, primarily because by virtue of its configuration it will be the easiest part on which to get a grip.

BRIEF DESCRIPTION OF THE DRAWINGS

In the following, the invention will be explained in more detail with reference to the drawing, where.

DESCRIPTION OF THE PREFERRED EMBODIMENTS

Figure 1:
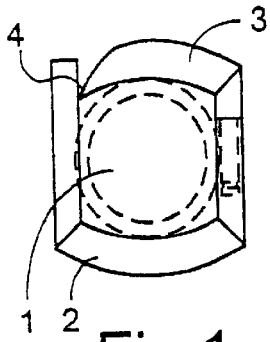
FIG. 1 shows a side view of a ring according to the invention, and the individual parts of which it consists seen from "the finger side"

FIG. 1 shows a finger 1 on which a ring 2 has been placed, where the pivotal element 3 is placed in its normal wearing position and the snap-lock 5 on the pivotal element is in its locked position 4.

Figure 2:
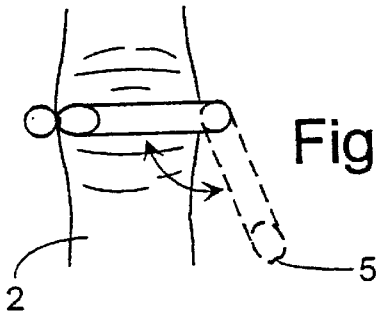
FIG. 2 shows a view of the openable ring seen from above.

FIG. 2 shows the same finger with opened ring seen from above, and with the pivotal element 3 turned out from its locked position 4.

Figure 3:
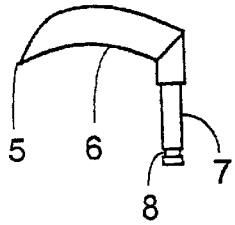
FIG. 3 shows a side view of the configuration of pivotal elements.

In FIG. 3, the pivotal element 6 is shown separately, where the actual engagement part 5 (FIG. 2) of the snap-lock 4 is configured to co-operate with the remaining part of the ring section, i.e. where the snap-lock will depend on the elastic extensibility between the free ends of the U-shaped ring part, and where the pivotal element 6 is provided with a pin part 7 with smaller diameter and a key groove 8 intended for insertion in a bore 12 in the one side piece 9 (FIG. 4) of the U-shaped ring part, and subsequent securing by means of a groove pin 11.

Figure 4:
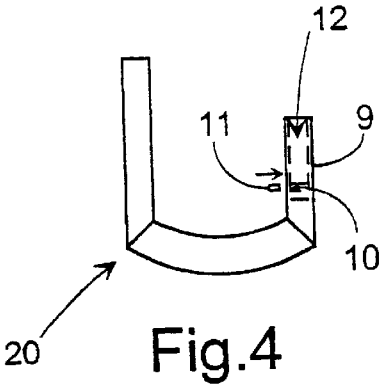
FIG. 4 shows a side view of the ring without the pivotal element inserted.

FIG. 4 shows the U-shaped ring part 20 without the pivotal element 6 which is mounted in the ring side piece 9 in a hole 10 positioned in such a manner that the groove pin 11 is brought into engagement with the key groove 8 on the pivotal element. The groove pin 11 is fastened after mounting in the ring side piece 9. The fastening can take place in several ways, such as by gluing, riveting, soldering, brazing or welding. In a preferred embodiment, brazing is used with a hard solder of the relevant metal of which the ring is configured.

Figure 5:
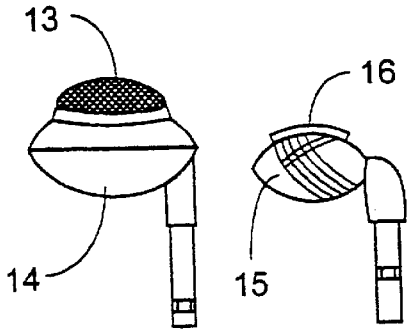
FIG. 5 shows various examples of preferred and used embodiments of the pivotal element.

FIG. 5 shows examples of design embodiments of the pivotal element with a precious stone 13 mounted in a combined body/setting element 14, and a body element 15 with metal pattern 16 or enamel applied.

Figure 6:
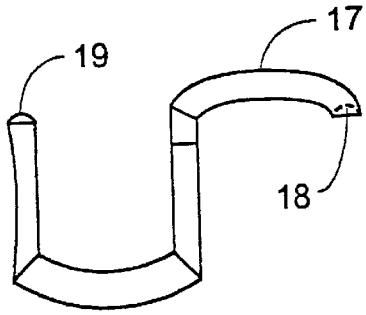
FIGS. 6 and 6A show side views of an example of a preferred embodiment of a modified ring according to the invention.
Figure 6A:
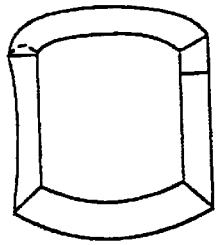

In FIG. 6 the pivotal element 17 is seen turned outwards, where the actual engagement parts of the lock consist of mutually suitable convex and concave parts configured respectively as a concave depression 18 in the end surface of the pivotal part of the ring, facing towards a convex part 19 on the remaining "fixed" part of the ring section, where the engaging parts 18, 19 are brought into locking engagement by the turning-in of the pivotal part over the "fixed" part as shown in FIG. 6A, in that the engagement surfaces interlock firmly with each other in the normal wearing position by virtue of the natural flexibility of the ring. Here, use is thus made of the ability of the ring element to flex in the peripheral direction.

In addition to the advantage already described above, a finger-ring according to the invention also has the following special advantages: that the pivotal part can in a particularly simple manner be arranged for widely different embodiments and design variations while using the very same turning and locking mechanisms as described earlier for the pivotal element, in that this can be configured especially for the support of setting elements for precious stones, enamels and the like, and sculptural configurations of body elements of metal. There is hereby achieved a considerable artistic freedom, while at the same time a module construction with standardised parts can be used.

In the drawing are shown embodiments with sharp-edged corners, which can well be accepted in practice, but it will be understood that the corners may just as well by distinctly rounded, and that the whole of the U-shaped ring part can be rounded except for that part which accommodates the pivot pin 7.

Having thus described the invention with particular reference to the preferred form of mechanism, it will be obvious to those skilled in the art to which the invention pertains, after understanding the invention, that various changes and modifications may be made therein without departing from the spirit and scope of the invention as defined by the claims appended hereto. Positional or relative references of different elements of the invention shown in the drawings have been made throughout the specification merely to facilitate the explanation of the preferred embodiment, and such references should not be viewed as limiting on such elements for all embodiments. Similarly it will be appreciated that dimensions, shapes, materials and such can be varied to suit individual tastes and requirements.

What is claimed is:

1. Finger-ring jewelry comprising, a finger-ring for mounting on a finger of a wearer, with a ring element supporting a setting and further comprising a basic ring segment and an openable ring segment bridging ends of the basic ring segment in hinged connection, said hinged connection having a pivot pin on one of the segments and a bore for receiving the pivot pin on another of the segments, said hinged connection located on one end of the finger-ring and a releasable locking connection between the openable ring segment and the basic ring segment located on the other end and defining a closed position, said hinged connection thereby enabling lateral mounting and removal of the ring element relative to the finger of the wearer, wherein the openable ring segment is arranged such that from the closed position the openable ring segment is pivotable laterally out of a plane of the finger-ring, the openable ring segment itself being straight or sufficiently slightly curved to be able to pass over said finger when being swung out from or into the closed position.

2. The finger-ring according to claim 1, in which the openable ring segment is extended with an angled part, which with the pivot pin is in rotatable connection with the bore which is in an adjacent end of said basic ring segment.

3. The finger-ring according to claim 1, in which means for stabilizing the openable ring segment in the closed position are designed as retainer means enabling the openable ring segment to be opened and closed merely by forced swinging of the openable ring segment.

4. The finger-ring according to claim 3 wherein the openable ring segment is stabilized in the closed position by snap-locking between a free end of the openable ring segment and an opposite end piece of said basic ring segment while using elasticity of the ring element itself.

5. The finger-ring according to claim 4, wherein the snap-locking of the finger-ring is established between a free edge of the openable ring segment and an inner side of an opposite end part of the basic ring segment.

6. The finger-ring according to claim 4, wherein the snap-locking is established between an inner side of an outer end part of the openable ring segment and an end surface of an opposite end part of the basic ring segment.

7. The finger-ring according to claim 1, wherein a branch of said basic ring segment hingedly supports the openable ring segment and has an outer, straight end part of appreciable length with the bore for receiving the pivot pin, and wherein the pivot pin is configured as an integral part of the openable ring segment.

8. The finger-ring according to claim 7, wherein the pivot pin is configured with an annular groove for co-operation with a locking pin inserted through the wall of the bore.

9. The finger-ring according to claim 1, wherein the openable ring segment carries the setting, and the basic ring segment is of standard configuration.

10. A finger-ring, said finger ring comprising a basic ring segment, an openable ring segment bridging ends of the basic ring segment in hinged connection, said hinged connection having a pivot pin on one of the segments and a bore for receiving the pivot pin on another of the segments, said hinged connection located on one end of the finger-ring and a releasable locking connection between the openable ring segment and the basic ring segment located on the other end said hinged connection thereby enabling lateral mounting and removal of the finger-ring relative to a relevant carrier limb portion, wherein the openable ring segment is arranged such that when the openable ring segment is in locked connection with said basic ring segment the openable ring segment is pivotable laterally out of a plane created by the openable ring segment in the locked connection with the basic ring segment of the finger-ring, said openable ring segment itself being straight or sufficiently slightly curved to be able to pass over said carrier limb portion when being swung out from or into said releasable locked connection with said basic ring segment and that the openable ring segment is extended with an angled part, the pivot pin in the one of the segments is in rotatable connection with the bore in an adjacent end of the other of the segments.

11. Finger-ring according to claim 10, further comprising means for stabilizing the openable ring segment in the locked connection are retainer means enabling said openable ring segment to be opened and closed merely by forced swinging of the openable ring segment.

12. Finger-ring according to claim 11, wherein the openable ring segment is stabilized in the locked connection by snap-locking between a free end of said openable ring segment and an opposite end piece of said basic ring segment while using elasticity of the finger-ring itself.

13. Finger-ring according to claim 12, wherein the snap-locking is established between the free end of the openable ring segment and an inner side of said opposite end piece of the basic ring segment.

14. Finger-ring according to claim 12, wherein the snap-locking is established between an inner side of an outer end part of the openable ring segment and an end surface of said opposite end piece of the basic ring segment.

15. Finger-ring according to claim 10, wherein a branch of said basic ring segment hingedly supports the openable ring segment and has an outer straight end part of appreciable length with a the bore for receiving the pivot pin which and wherein the pivot pin is configured as an integral part of the openable ring segment.

16. Finger-ring according to claim 15, wherein the pivot pin is configured with an annular groove for co-operation with a locking pin inserted through a wall of the bore.

17. Finger-ring according to claim 10, wherein the openable ring segment carries a jewelry setting, and the basic ring segment is of standard configuration.

* * * * *

UNITED STATES PATENT AND TRADEMARK OFFICE

CERTIFICATE OF CORRECTION

PATENT NO. : 6,701,746 B1
DATED : March 9, 2004
INVENTOR(S) : Daniel Bentley

It is certified that error appears in the above-identified patent and that said Letters Patent is hereby corrected as shown below:

Title page,
Item [86], Section 371 (c) (1), (2), (4) Date should read -- November 8, 2001 --

Signed and Sealed this

Twenty-sixth Day of October, 2004

JON W. DUDAS
*Director of the United States Patent and Trademark Office*